US010467858B2

(12) United States Patent
Bobes et al.

(10) Patent No.: US 10,467,858 B2
(45) Date of Patent: Nov. 5, 2019

(54) SOCIAL MEDIA INSTANT WIN METHOD AND SYSTEM

(71) Applicant: Epsilon Data Management, LLC, Irving, TX (US)

(72) Inventors: Lucica Bobes, Shelton, CT (US); Robert L. Gainer, Easton, CT (US)

(73) Assignee: Epsilon Data Management, LLC, Irving, TX (US)

( * ) Notice: Subject to any disclaimer, the term of this patent is extended or adjusted under 35 U.S.C. 154(b) by 1008 days.

(21) Appl. No.: 14/955,538

(22) Filed: Dec. 1, 2015

(65) Prior Publication Data

US 2016/0155288 A1 Jun. 2, 2016

Related U.S. Application Data

(60) Provisional application No. 62/085,893, filed on Dec. 1, 2014.

(51) Int. Cl.
*G07F 17/32* (2006.01)

(52) U.S. Cl.
CPC ..... *G07F 17/326* (2013.01); *G07F 17/32* (2013.01); *G07F 17/329* (2013.01)

(58) Field of Classification Search
CPC ..... G07F 17/329
See application file for complete search history.

(56) References Cited

U.S. PATENT DOCUMENTS 5,231,568 A * 7/1993 Cohen ..... G06Q 30/0209 463/17
6,375,568 B1 4/2002 Roffman et al.
2010/0019453 A1* 1/2010 Oakes ..... G07F 17/32 273/269

(Continued)

FOREIGN PATENT DOCUMENTS

WO WO 2010/115063 A1 10/2010
WO WO 2014/015387 A1 1/2014

OTHER PUBLICATIONS

"The Road to the Emerald City Sweepstakes and Instant Win", published Jan. 1, 2013. Source http://viewsfromtheville.com/2013/01/01/road-to-the-emerald-city-sweepstakes (Year: 2013).*

(Continued)

*Primary Examiner* — Steven J Hylinski
(74) *Attorney, Agent, or Firm* — Duane Morris LLP

(57) ABSTRACT

A system and method for carrying out instant win games to benefit a consumer who is connected on-line with a social media network, where the system includes a data base coupled to the social media network, and an instant win processor control unit connected to the data base and to the social media network for processing instant winners connected with the social media network. The method includes a consumer establishing communication on-line with a social media network through a computing device and that the said consumer receives a message from a brand conducting a promotion on the social media network indicating an opportunity to participate in an instant win game play via the social media network. The consumer will then re-send the message with a requested identifier, and the consumer receives a notice that the game play has resulted in either a win or a loss.

1 Claim, 4 Drawing Sheets

(56) References Cited

U.S. PATENT DOCUMENTS

2010/0105462 A1* 4/2010 Walker ..... G07C 15/006 463/17
2010/0228617 A1* 9/2010 Ransom ..... G06Q 30/02 705/14.25
2011/0014972 A1* 1/2011 Herrmann ..... G06Q 30/0224 463/25
2011/0053692 A1 3/2011 Farr-Jones et al.
2012/0061951 A1* 3/2012 Upshaw ..... G07F 17/32 283/102
2012/0102113 A1 4/2012 Chartier et al.
2012/0202571 A1 8/2012 Stanek et al.
2012/0254184 A1* 10/2012 Choudhary ..... G06Q 30/0201 707/738
2014/0004944 A1* 1/2014 Lee ..... G07F 17/3225 463/31
2014/0087814 A1 3/2014 Babineau et al.
2014/0121013 A1 5/2014 Carson et al.
2014/0228087 A1 8/2014 Skatter
2014/0256408 A1* 9/2014 Meyer ..... G07F 17/3227 463/25
2015/0119125 A1* 4/2015 Mound ..... G07F 17/329 463/17

OTHER PUBLICATIONS

"OZ The Great and Powerful Twitter Sweepstakes—Win a Trip to the Emerald City", by Jennifer Sikora, published Jan. 1, 2013. Source: https://5minutesformom.com/70488/oz-the-great-and-powerful-twitter-sweepstakes-win-a-trip-to-the-emerald-city (Year: 2013).*

"10 Real Time Twitter Games You Can Enjoy With Just a Tweet" by Saikat Basu, published Oct. 6, 2010. Source https://www.makeuseof.com/tag/10-real-time-twitter-games-enjoy-tweet (Year: 2010).*

Parr, Ben; "6 Twitter Games to Make Tweeting Fun"; http://mashable.com/2009/03/28/twitter-game/; XP055245898; Mar. 29, 2009.

* cited by examiner

SOCIAL MEDIA INSTANT WIN METHOD AND SYSTEM

CROSS REFERENCE TO RELATED APPLICATION

This application claims benefit to U.S. Provisional Patent Appl. Ser. No. 62/085,893, filed Dec. 1, 2014, and entitled "Twitter Instant Win Method and System", which is hereby incorporated by reference in its entirety.

FIELD OF THE INVENTION

The present invention relates to what is commonly referred to as "instant win" games. More particularly, the invention is directed to methods and systems for implementing instant win games and opportunities while using social media communication networks.

BACKGROUND OF THE INVENTION

Instant win lottery games have been extremely popular for decades. These games offer the benefit of instant gratification compared to other similar type games, whether administered by government lottery authorities or by private business. Accordingly, they have attracted broad appeal. Most instant win games and programs involve the issuance of lottery type tickets which either contain a pre-printed lottery number or a "scratch-off surface", which when removed reveals whether the holder of the ticket is an instant winner. In other similar games the user must check its pre-printed serial number against a published list to determine if the ticket holder is a winner New forms of instant win type games are regularly being created and quickly develop interest by a large segment of the population. As such, it is desirable to provide new and innovate games that both provide the opportunity for a player to win a prize, and also provide a variety of ways of winning the prize, which adds to the entertainment value of and interest in the instant win game. Further, instant win games in environments that do not require the issuance of a lottery type ticket are becoming even more popular.

Various gaming systems incorporating instant win characteristics are also known and have been previously described. For example, U.S. Pat. No. 6,375,568 to Roffman et al. , which is hereby incorporated in its entirety by reference, discloses an interactive gaming process and system having a plurality of gaming machines to be played by a plurality of players. The system can be configured such that the gaming machines are either located in a casino or at internet locations. Each gaming machine comprises a wagering game and a theme game. The wagering game has features that correspond to the theme game wherein the results of the wagering game influence the results of the theme game as the wagering game is being played. The system also includes a controller for electronically linking the gaming machines and providing stimuli to the gaming machines to affect gaming machine outputs that are impartial and random. In one embodiment, the plurality of players play the wagering game as a group wherein if one player's theme game results meet predetermined criteria, that particular player will play for the group. The group will then have the opportunity to split a jackpot. In another embodiment, the plurality of players play as a group wherein activation of each player's wagering game either helps or hinders the group as a whole in its effort to achieve a predetermined goal. In a further embodiment, the players play their respective wagering game to directly compete against each other in the theme game. The results of the wagering games determine the winnings of each player, the eventual winner of the theme game and/or any predetermined jackpot.

However, the forgoing types of instant win games and themes are usually associated with stand-alone gaming systems and are rarely integrated with other systems, such as social media communication networks.

BRIEF SUMMARY OF THE INVENTION

It is accordingly, a very general object of the present invention is to provide a system and method allowing the interest and excitement of an instant win lottery type game while involved in communicating or interacting over a social media network. Another very general object of the present invention is to provide a method and system for instant win games while using social media communications techniques. In one aspect, the invention is directed to a method of conducting an instant win game in combination with interactive communications on a social media network. The method may include receiving a message regarding an opportunity to participate in an instant win game and subsequently receiving messages via the social media network that the user has either won or did riot win a prize.

A feature of the system of the invention for carrying out instant win games to benefit a consumer who is connected on-line with a social media network, includes a data base coupled to the social media network, and an instant win processor control unit connected to the data base and to the social media network for processing instant winners connected with the social media network.

In an aspect of the invention, the instant win processor control unit has an instant win engine, a stream listener processor unit, and a messenger processor unit where the instant win engine, stream listener unit and messenger processor unit are either housed within the control unit or are compiled into a single application that is installed and run as a publically accessible web server coupled with the instant win processor control unit.

A further aspect of the invention is that the instant win engine is an application that executes instant win game plays and records results, and which includes a play eligibility algorithm, and a play instant win algorithm. The play eligibility algorithm determines if a consumer can play the instant win game based on rules of the social media network, and the play instant win algorithm determines if the consumer is a winner of the instant win game. If the play eligibility algorithm determines that if a consumer can play the instant win game, then the play eligibility algorithm initiates an instant win play opportunity. However, if the play eligibility algorithm determines that if a consumer cannot play the instant win game because this consumer has already played the game then the play eligibility algorithm transmits a message to the messenger processor unit that the game has been played by this consumer for further processing.

In a further aspect of the invention, when the play instant win algorithm determines that a consumer is a winner of the instant win game then the play instant win algorithm will generate and record a game play WIN status and associated prize information, and will transmit this record of a game play WIN status and associated prize information to the messenger processor unit for further processing. However, if the play instant win algorithm determines that a consumer is not a winner of the instant win game, then the play instant win algorithm will generate and record a game play LOSS (i.e., not a win) status, and will transmit that record of a game play LOSS status to the messenger processor unit for further processing.

In another aspect of the invention, the stream listener unit has a message filtering unit to filter public messages from the social media network to identify promotional messages and participating brands, and matching messages are transmitted by the stream listener unit for processing by the instant win engine.

Yet another aspect of the invention is that the messenger processor unit is an application that generates public status replies and messages for prize claims. The messenger processor unit has a message receiver processor for processing and sending instant win game play results to consumers on-line with the social media network, a check follow status algorithm which determines if a consumer follows a brand on the social media network, and a messenger queue algorithm for continuously polling for new followers of brand accounts active on the social media network and for transmitting information regarding the new followers to the messenger receiver processor.

Another aspect of the system of the invention is a plurality of API integration touch-points between the social media network and the instant win processor control unit. One of these touch-points is a message listener to acquire a public stream of messages containing certain predetermined characteristics. Another such touch point is a public reply processor to send public replies including notifications an instant win to a consumer.

Features for the method of the invention for carrying out and processing instant win games to benefit a consumer who is connected on-line with a social media network, includes establishing communication by the consumer with a social media network through a computing device, and having the consumer receiving a message from a brand that is conducting a promotion on the social media network indicating an opportunity to participate in an instant win game play via the social media network, the consumer re-sending the message with a requested identifier, and the consumer receiving a notice that the game play has resulted in either a win or a loss.

BRIEF DESCRIPTION OF THE DRAWINGS

In the drawings, like elements are depicted by like reference numerals. The drawings are briefly described as follows.

DETAILED DESCRIPTION OF AN EMBODIMENT OF THE INVENTION

The invention will be described in connection with a user (sometimes herein also referred to as a "consumer", user and consumer being used interchangeably) interacting with or communicating over a particular currently popular social media network known as Twitter®[1]. While reference will be made to Twitter, it should be understood that the principals and features of the present invention may be equally applicable to other social media networks.

[1]Twitter® is a registered trademark of Twitter Inc. (NYSE: TWTR).

Figure 1:
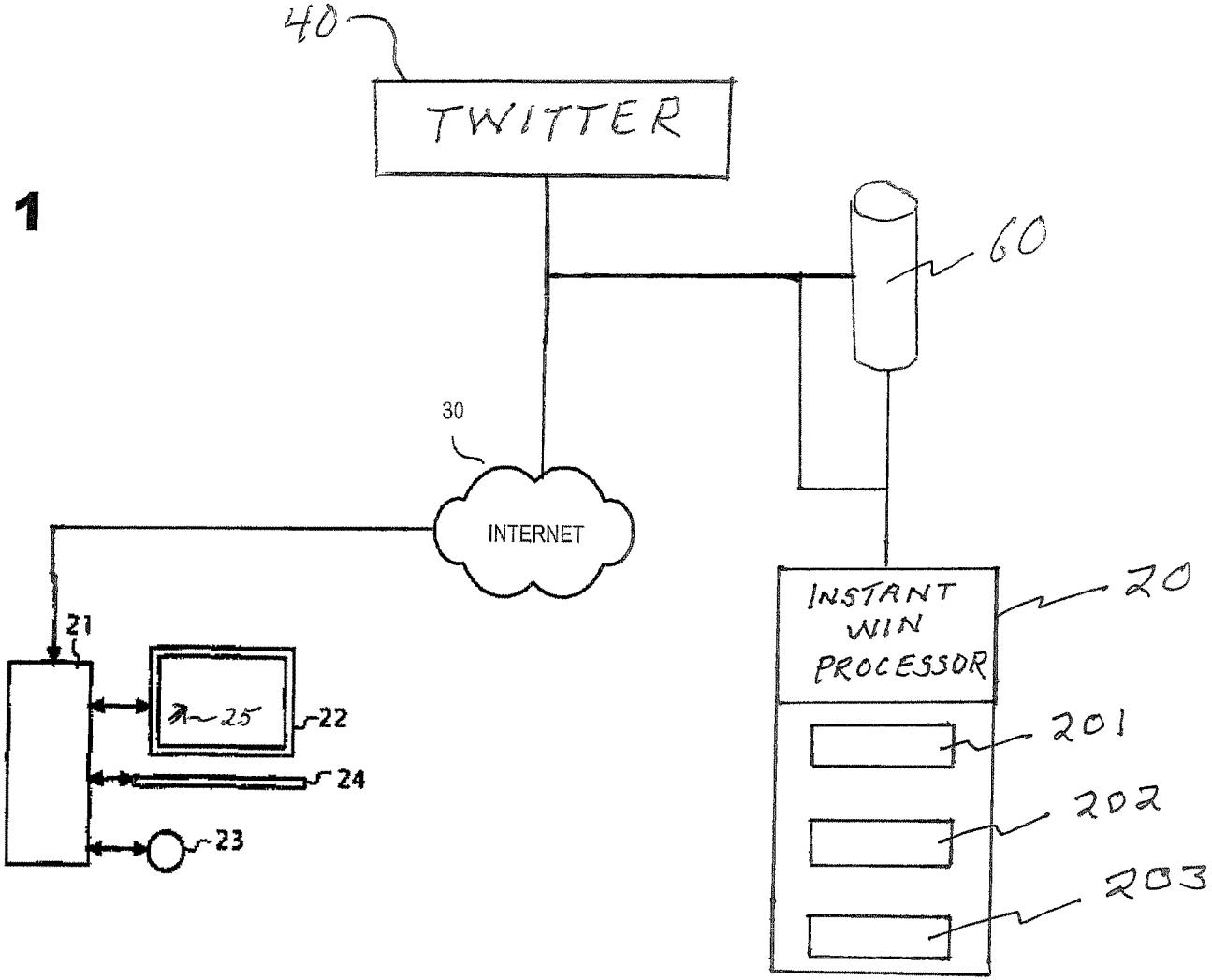
FIG. 1 is a general overall system architecture that incorporates the present invention.
Figure 2:
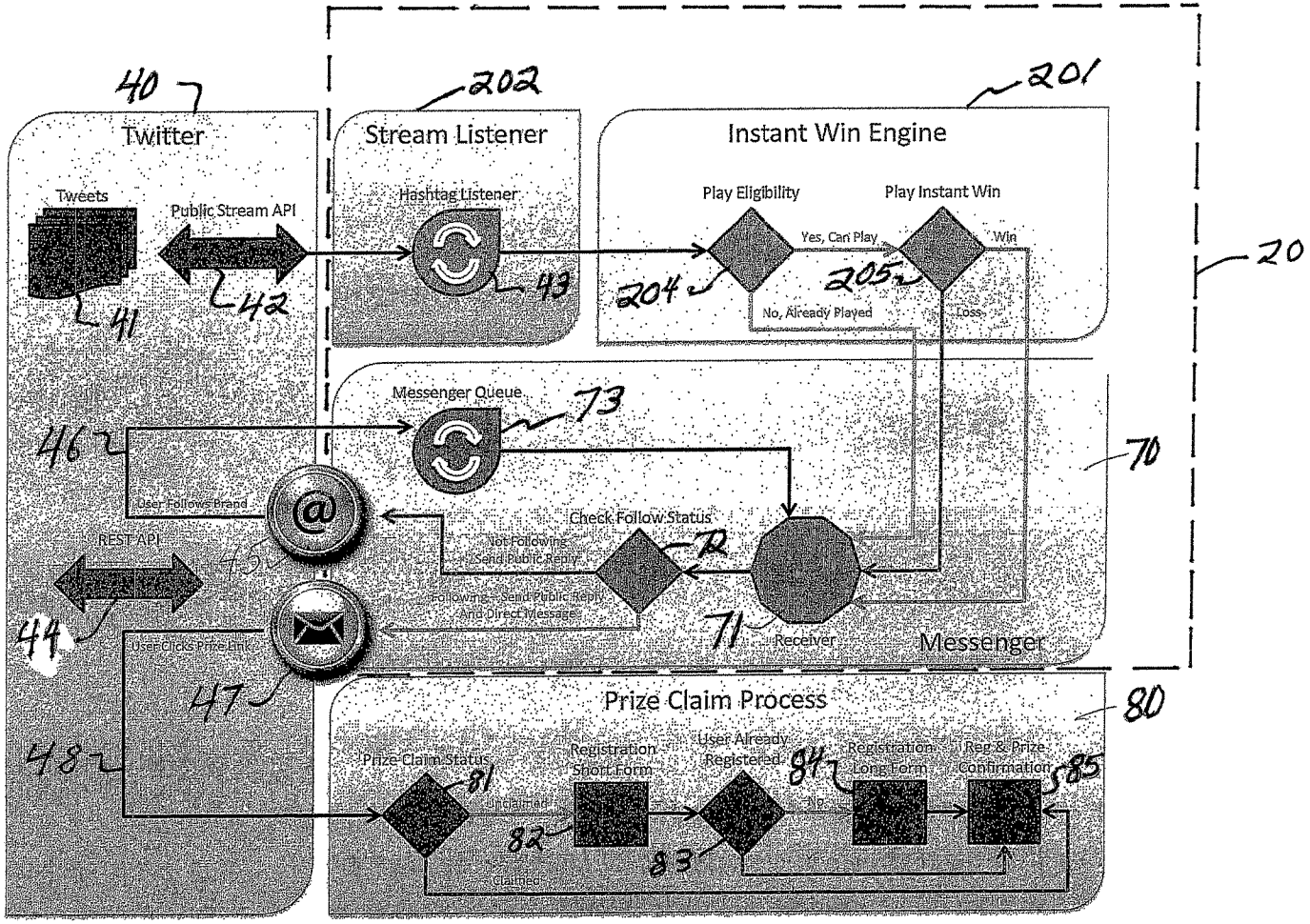
FIG. 2 is schematic illustration of the component architecture and system work flow of one embodiment of the current invention.

With reference to FIG. 1, in general terms, therefore, the system of the present invention includes a data base 60 coupled with an instant win processor control unit 20, both of which are coupled with a social media network such as Twitter 40. A user will access the system of the invention when he or she connects on-line with Twitter 40. This is accomplished using a computing device 21 (whether that be a desktop computer, mobile computing device or other similar computer system) which is intended to be operated by a user and can be connected either by hard wire or wireless techniques to the Internet 30 for connection to the social media network, Twitter 40. The computer 21 is connected to a display screen 22 so that a graphical user interface ("GUI") may be displayed on the display screen for observation and interaction by a user. A mouse device 23 can be connected to the computer 21 in order to allow a user to manipulate a curser 25 over the GUI for designating web site selections and choices that are well known to be available on social media sites and which are displayed on the screen 22. A key board 24 may also be connected to the computer to facilitate the user inputting data and other information to be transferred over the Internet to the social media site. When a user desires to connect with the Twitter social media network, the user will use the mouse 23 and/or keyboard 24 to navigate over the Internet to the Twitter website: http://www.twitter.com. A third party, such as the assignee of the present invention, Epsilon Data Management, LLC ("Epsilon"), maintains and operates the database 60 for interaction with the Twitter web based network.

The instant win processor control unit 20 contains an instant win engine component 201, a stream listener processor unit 202 and a messenger processor unit 203. The instant win engine 201, stream listener processor unit 202 and messenger processor unit 203 may be housed within controller unit 20 or may be compiled into a single Windows®[2] application that is installed and run as a Windows service on a publically accessible web server 50.

[2]Windows® is a registered trademark of the Microsoft Corporation.

Leveraging Epsilon's existing instant win promotional model, a new instant win promotion is setup in the database 60. The model randomly seeds winning times for each of the prizes across the duration of the promotion. The first user who plays after a seeded winning time wins that prize. All instant win activity (wins and non-wins, or losses) are recorded in the database 60 and tied to each individual user.

The instant win engine 201 is an application that executes instant win game plays and records/returns results.

Twitter REST 41 retrieves public tweets from public streaming API 42. Post status replies, send direct messages, and check messaging permissions via the Twitter REST API 44. (A "tweet" is common usage for a post made on a social media network.)

Stream listener 2 is a public stream listener to get or acquire mentions of one or more hashtags with associated brands via hashtag listener 43. A hashtag is a type of label or metadata tag used on social network and microblogging services which makes it easier for users to find messages with a specific theme or content and serves as an identifier. Users create and use hashtags by placing the hash character (or number sign) # in front of a word or un-spaced phrase, either in the main text of a message or at the end. Searching for that hashtag will then present each message that has been tagged with it.

For example, on the photo-sharing service Instagram®[3] the hashtag #bluesky allows users to find images that have been tagged as containing the sky. Because of its widespread use, hashtag was added to the Oxford English Dictionary.

[3]'Instagram' is a registered trademark of Instagram, LLC.

Messenger processor unit 70 is an application that generates public status replies and messages for prize claims.

The prize claim process 80 processes flow of a prize token validation to email/CAPTCHA short form to full registration form to a thank you/prize details page.

While using the Twitter network a user will post a tweet at 41. The tweet will be delivered to the public stream API 42, which delivers all publically available tweets as they are posted. The hashtag listener 43 filters public tweets looking for mentions of the promotion hashtag(s) and participating brand(s). Matching tweets are sent for processing by the instant win engine 201. The instant win engine 201 includes algorithm 204 which determines if a user can play based on unique Twitter ID and promotion rules (for example, once per day or once per promotion).

(a) If "Yes, Can Play" is determined at 204, the 204 algorithm initiates an instant win play opportunity.

(b) If "No, Already Played" is determined, algorithm 204 generates a game play with "ALREADYPLAYED" status and transmits this to messenger 70 for processing.

The play instant win algorithm 205 housed in instant win engine 201 determines if the user is a winner. There are two possibilities.

(a) If algorithm 205 determines a "Win", it will generate and record game play with the "WIN" status and associated prize info and transmit this to messenger processor unit 70 for processing.

(b) If algorithm 205 determines a "Loss", it will generate and record game play with the "LOSS" status and transmit this to messenger unit 70 for processing.

The messenger receiver 71 processor processes and sends all instant win game play results to Twitter users from Brand Twitter Accounts.

The check follow status algorithm 72 determines if a user follows the brand on Twitter. Here, there are two possibilities.

(a) If the check follow status algorithm 72 determines a "Following" status, it will send a public reply of non-WIN Game Play results via Twitter public reply processor 45 with a status reply from the brand which appears in the user's email feed or Twitter notification with the game play results. Non-following winners will be instructed to follow the brand to claim a prize and will send winners a direct message with a "Prize Claim Link", which is a hyper-link that the user can "click-on" to determine the prize.

(b) If the check follow status algorithm 72 determines a "Not Following" status it will send a public reply of the game play result. If WIN, the reply will include instructions to follow the brand to claim a prize.

The Twitter REST API 44 enables status updates and direct message creation on Twitter, and checks for "following" relationships between brand(s) and users to direct message winning game play results.

Where a user chooses to follow a brand Twitter account and generates a follow event that is broadcast by a Site Stream API 46.

The messenger queue 73 continuously polls for new followers of brand accounts and sends them to the messenger receiver 72 to direct message winners with a Prize Claim Link.

Twitter direct message 47 directs messages from brands with a unique link to claim a prize won.

The user can click a prize link 48 where the user chooses to follow the unique prize claim link 81 in the direct message from the brand and it is sent through to the Prize Claim Process 80.

The Prize Claim Status algorithm 81 checks the prize claim token's validity and its claim status. There are three possibilities.

(a) If the Prize Claim Status algorithm 81 determines that the prize claim token is a "Valid Token AND Prize is Unclaimed", it will send the user to the Registration Short Form web site 82 where the user can process the claim for the prize. The Registration Short Form site 82 asks the user to enter their email address and fill out CAPTCHA security challenge (the Registration Short Form site 82 is only required if users can win more than once per promotion period).

(b) If the Prize Claim Status algorithm 81 determines that the prize claim token is a "Valid Token AND Prize has been Claimed", it will send the user to Reg & Prize Confirmation site 85. Here the user can confirm the that the prize has been claimed.

(c) If the Prize Claim Status algorithm 81 determines that the prize claim token is a "Not Valid Token", it will redirect the user to the brand selected URL or display "Sorry/Access Denied" message.

The User Already Registered site 83 determines if user has previously completed Registration Long Form. There are two possibilities.

(a) If "No, User Has Not Registered" this site will send the user to the Registration Long Form site 84. The Registration Long Form site 84 asks user to enter their full contact information and update brand opt-ins.

(b) If "Yes, User Has Registered", this site will send the user to Reg & Prize Confirmation site 85. The Reg & Prize Confirmation site 85 will display the awarded prize details and fulfillment instructions and will mark the prize as claimed.

In the system of the invention, there are a number of Twitter API integration touch-points.

One such touch-point is at the Hashtag Listener 43 to acquire (GET) a Public Stream of tweets and all tweets containing the one or more predetermined hashtags. Reference: https://dev.twitter.com./streaming/reference/post/statuses/filter Endpoint: https://stream.twitter.com/1.1/statuses/filter.json track="[HASHTAG(s)]
delimited="length"
stall_warnings="true"

Second, is for the function of 'Get Brand to User Relationship' and to determine if the brand can direct message user. Here the receiver processor 71 and the Check Follower Status algorithm 72 are used. Reference: https://dev.twitter.com/rest/reference/get/friendships/show Endpoint: https://api.twitter.com/1.1/friendships/show.json source_id="[BRAND TWITTER ID]"
target_id="[USER TWITTER ID]"

Next, using the Twitter public reply processor 45 is to 'Send Public Replies' including to notify hashtaggers (users) of their instant win play result and to instruct non-following winners to follow the brand to claim their prize via DM. Reference: https://dev.twitter.com/rest/reference/post/statuses/update Endpoint: https://api.twitter.com/1.1/statuses/update.json status="[REPLY TEXT with INSTANT WIN RESULT and @USERNAME]"
in_reply_to_status_id="[ID of HASHTAGGED USER TWEET]"
trim_user ="true"

Finally, there is the function of 'Send Direct Message to Followers' to send a unique prize claim URL to a user upon instant win play AND win via link 48. Reference: https://dev.twitter.com/rest/reference/post/direct messages/new Endpoint: https://api.twitter.com/1.1/direct messages/new.json user_id="[USER ID]"

screen name="[BRAND TWITTER ID]"

text="[REPLY TEXT with PRIZE CLAIM URL]"

The Promo Stream Manager Windows Service authenticates as a Twitter application to the statuses/filter Public Streaming API statuses/filter endpoint (https://dev.twitter.com/streaming/reference/post/statuses/filter) and specifies the hashtag(s) that need to be tracked. Tweets containing the hashtag(s) are delivered to the service in real-time. The tweets go through a verification process to ensure that all required hashtags are included, at least one of the participating brands is mentioned via "@[BRAND TWITTER HANDLE]", no profanity or racial slurs are detected in the user's Twitter handle nor the text of the tweet, and the user has not been identified as a potential hacker/fraudulent account.

Once a tweet passes the verification process, the instant win engine 201 queries the database 60 to see if the user has already played within the current date. If the user has already played, no instant win play is executed and the "Already Played" game play response is sent to the Messenger 70. If the user has not yet played, an instant win play is executed and recorded in the database 60. If the play is a win, the game play response will include the associated prize information. Both winning and losing game play responses are sent to the Messenger 70 for delivery. The number and frequency of eligible instant win plays is variable per promotion, so the system could, for example, allow for 5 plays per day or 30 per promotion period.

When the Messenger 70 receives a response from the instant win engine 201, it uses the game play status ("Win", "Loss" or "Already Played") and brand-to-user relationship, in the case of a win, to generate the correct message and identify the appropriate Twitter endpoint to fulfill the request. Losses and Already Plays are sent as public replies via Twitter REST API 44 calls to the statuses/update endpoint (https://dev.twitter.com/rest/reference/post/statuses/update).

For Wins, the messenger process unit 70 determines if the brand can direct message the user by calling the friendships/show endpoint (https://dev.twitter.com/rest/reference/get/friendships/show) and checking the value of the "can_dm" flag within the response. If "true", the Messenger sends the Win direct message to the user using the direct_messages/new endpoint (https://dev.twitter.com/rest/reference/post/direct_messages/new). The direct message includes a unique prize claim link that will take the user to the prize claim process web site for redemption. If "false", the Messenger sends a public reply via statuses/update. The reply message instructs the user to follow the brand to claim their prize.

Any Win response that cannot be direct messaged is added to the messenger queue 73. Any response that, due to Twitter REST API rate limits (https://dev.twitter.com/rest/public/rate-limiting), cannot be delivered is also added to the queue. The messenger queue 73 runs every 5 minutes (can be configured) attempting to send out the responses in the queue. When a user who won follows, for example, the brand, the "can_dm" flag for direct messaging will become "true", and the Win direct message with the prize claim link will be sent.

The prize claim process web site can be a C# .NET 4.0 web application that runs under Microsoft IIS 7.x on a publicly accessible Windows web server. It has its own separate database for storage of winners' registration data and the associated prize token. It provides the ability for winners to enter their registration information, opt-in to corporate brand communications and claim their awarded prize.

When a winning user clicks on the prize claim link from the Twitter direct message, the user will be taken in their web browser to the prize claim process web site. The web site will send a request to the promo stream manager Windows service to validate the unique token in the link and retrieve the associated prize and claim status. This communication between the web site and service for prize token validation and claiming is conducted over HTTP using the Microsoft Windows communication foundation framework (http://msdn.microsoft.com/en-us/library/ms731082%28v=vs.110%29.aspx).

If the token is not valid, the user will be directed to a sorry page. If it is a valid token and the prize claim status is "unclaimed", the user is taken to the registration page where they must complete the form to claim their prize. If it is a valid token and the prize claim status is "claimed" OR the user completes the registration page, the user navigates to the thank you page where their prize information is displayed. In the case of digital prizing fulfillment, this page also displays the prize redemption code(s) and a link to the prize vendor's redemption site.

Figure 3:
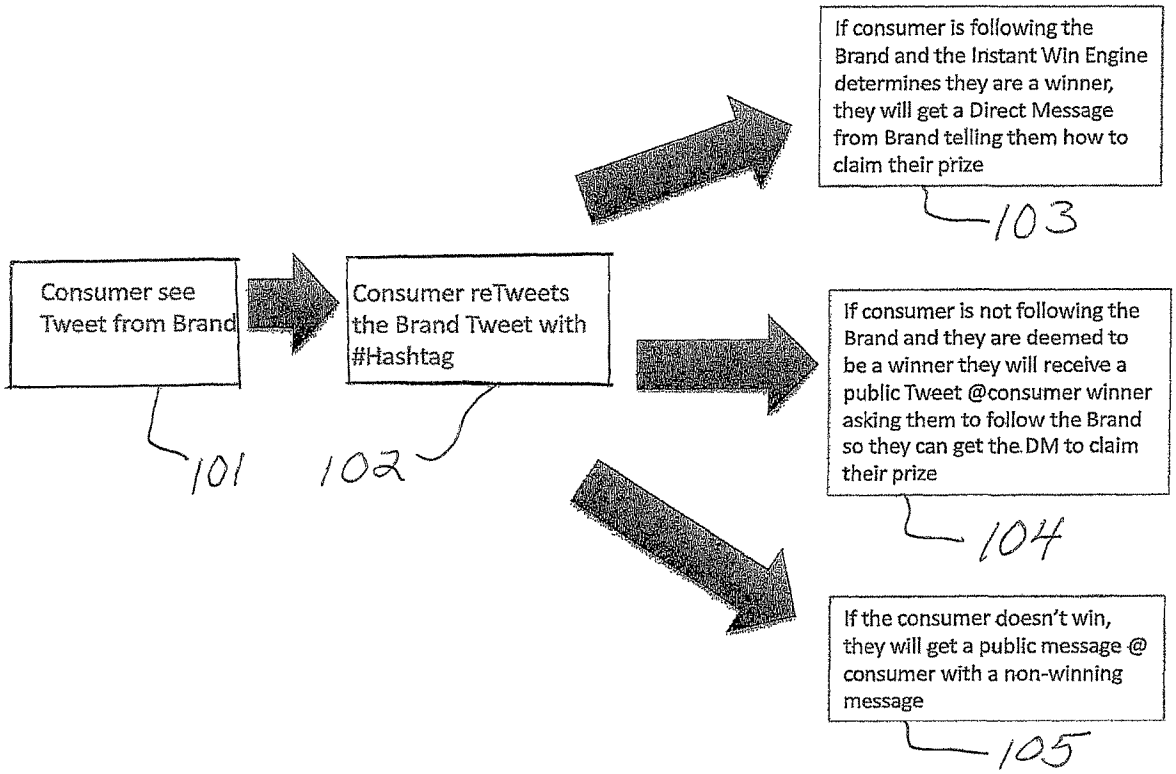
FIG. 3 is a process flow diagram illustrating the steps of the process of the embodiment illustrated in FIG. 1.

FIG. 3 illustrates key elements of the process of the present invention. Here, as illustrated, at step 101, the user (or sometimes herein referred to as a "Consumer") while interacting with the social network Twitter may see in his/her computer screen 22 a tweet from a particular company (i.e., "brand"). The consumer then, at step 102, reTweets the barnd tweet with the designated #Hashtag. If at step 103, the consumer is a follower of the brand and the instant win engine 201 determines that the user is a winner, then the winner will receive a direct message from the brand telling that user how to claim his/her prize. If, however, the consumer is not following the brand and they are deemed to be a winner, then they will receive a public tweet asking the consumer to follow the brand so that they can get a DM to claim their prize. If on the other hand, the engine 201 determines that this consumer is not a winner, then, at step 104, the consumer will receive a public message with a non-winning message.

Figure 4:
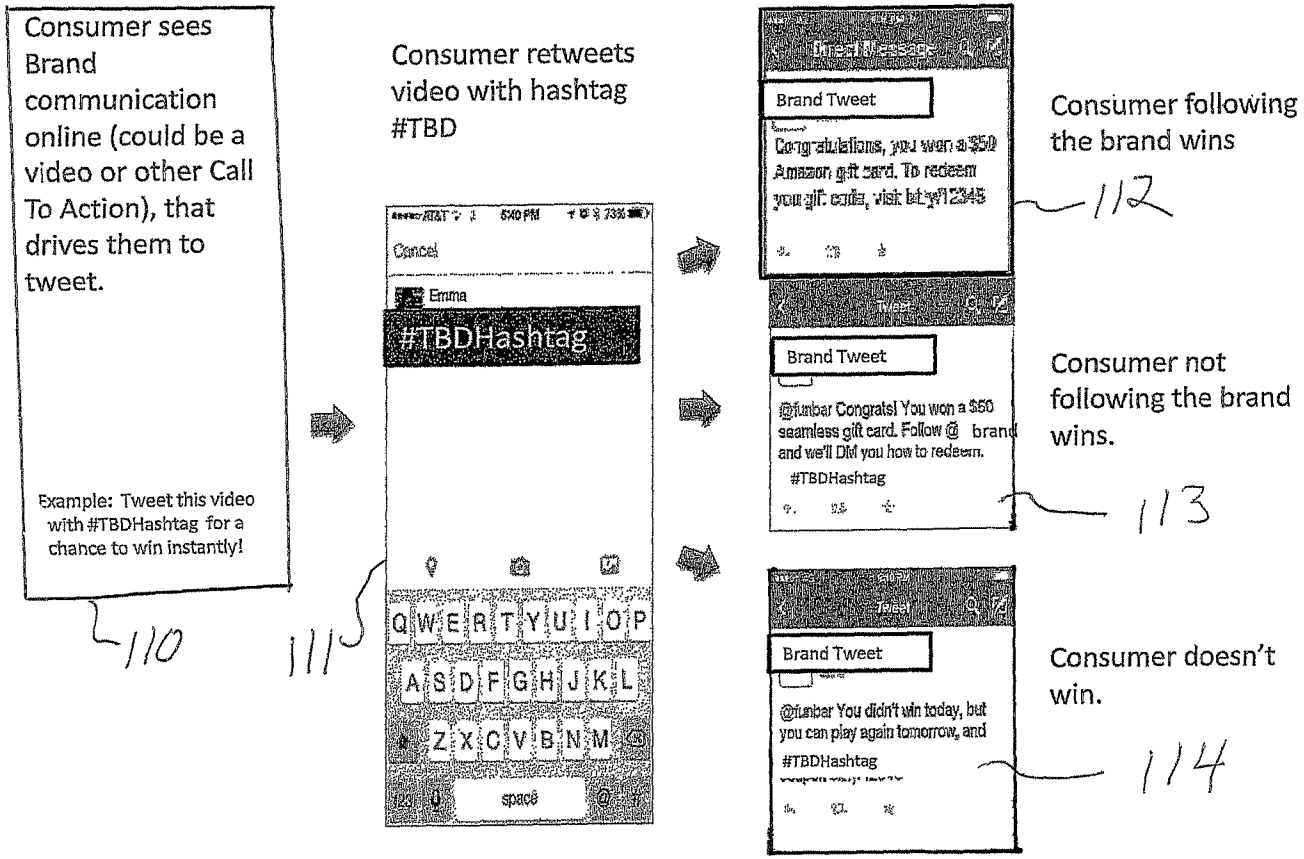
FIG. 4 is a flow diagram including computer screen pages seen by a consumer or user of the social media network combined with the present invention.

FIG. 4 illustrates tis process with views of the web pages that a consumer will be able to see. At step 110, the consumer will see a brand communication on line while observing his/her display screen 22. This communication could be a video, or other call to action that will drive the consumer to tweet. One example of such a tweet is the video illustrated at 111 with the #TBDHashtag for a chance at an instant win. If it is determined that the user is a brand follower and is a winner, it will receive the brand tweet illustrated at 112. If, as noted above, the consumer is not a brand follower, but is determined to be a winner, that consumer may receive the brand tweet at 113. And, if the consumer is determined not to be a winner, that consumer will receive a tweet message such as at 114.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed is:

1. A method for carrying out and processing instant win games to benefit a consumer who is connected on-line with a social media network, comprising establishing communication by said consumer with a social media network through a computing device, said consumer receiving a message from a brand conducting a promotion on said social media network indicating an opportunity to participate in an instant win game play via said social media network, said consumer re-sending said message with a requested identifier, and said consumer receiving a notice that the game play has resulted in either a win or a loss.

* * * * *